US008240387B2

(12) United States Patent
Hoffman et al.

(10) Patent No.: US 8,240,387 B2
(45) Date of Patent: Aug. 14, 2012

(54) CASING ANNULUS TESTER FOR DIAGNOSTICS AND TESTING OF A WELLBORE

(75) Inventors: Corey Eugene Hoffman, Magnolia, TX (US); Dolphus C. Green, III, Spring, TX (US)

(73) Assignee: Wild Well Control, Inc., Houston, TX (US)

( * ) Notice: Subject to any disclaimer, the term of this patent is extended or adjusted under 35 U.S.C. 154(b) by 529 days.

(21) Appl. No.: 12/268,748

(22) Filed: Nov. 11, 2008

(65) Prior Publication Data

US 2010/0116504 A1 May 13, 2010

(51) Int. Cl.
*E21B 7/12* (2006.01)

(52) U.S. Cl. ..... 166/336

(58) Field of Classification Search ..... 166/336, 166/337, 250.08, 97.1, 75.13, 297, 361, 250.15; 73/40.5 R
See application file for complete search history.

(56) References Cited

U.S. PATENT DOCUMENTS

| | | | | | |
|---|---|---|---|---|---|
| 2,168,764 | A | * | 8/1939 | Day | 277/327 |
| 3,199,598 | A | * | 8/1965 | Loomis | 166/147 |
| 3,478,577 | A | * | 11/1969 | Hauk | 73/49.1 |
| 3,664,415 | A | * | 5/1972 | Wray et al. | 166/336 |
| 3,917,293 | A | | 11/1975 | Lewis et al. | |
| 4,116,272 | A | * | 9/1978 | Barrington | 166/340 |
| 4,230,180 | A | * | 10/1980 | Patton et al. | 166/185 |
| 4,641,708 | A | | 2/1987 | Wightman | |
| 5,372,198 | A | * | 12/1994 | North et al. | 166/363 |
| 6,253,856 | B1 | | 7/2001 | Ingram et al. | |
| 6,257,339 | B1 | | 7/2001 | Haugen et al. | |
| 6,405,803 | B1 | | 6/2002 | Giroux et al. | |
| 6,427,776 | B1 | | 8/2002 | Hoffman et al. | |
| 6,513,596 | B2 | * | 2/2003 | Wester | 166/336 |
| 6,568,475 | B1 | | 5/2003 | Grubb et al. | |
| 6,640,904 | B2 | | 11/2003 | Hoffman et al. | |
| 6,668,930 | B2 | | 12/2003 | Hoffman | |
| 6,695,057 | B2 | | 2/2004 | Ingram et al. | |
| 6,719,056 | B2 | | 4/2004 | Hoffman et al. | |
| 6,736,214 | B2 | | 5/2004 | Hoffman et al. | |
| 6,779,601 | B2 | | 8/2004 | Wilson et al. | |
| 6,827,145 | B2 | | 12/2004 | Fotland et al. | |
| 6,886,631 | B2 | | 5/2005 | Wilson et al. | |
| 6,945,330 | B2 | | 9/2005 | Wilson et al. | |
| 6,962,204 | B2 | | 11/2005 | Grubb et al. | |
| 6,978,841 | B2 | | 12/2005 | Hoffman et al. | |
| 7,004,248 | B2 | | 2/2006 | Hoffman et al. | |
| 7,066,284 | B2 | * | 6/2006 | Wylie et al. | 175/65 |
| 7,073,580 | B2 | | 7/2006 | Wilson et al. | |
| 7,114,558 | B2 | | 10/2006 | Hoffman et al. | |
| 7,128,157 | B2 | | 10/2006 | Hoffman et al. | |
| 7,152,680 | B2 | | 12/2006 | Wilson et al. | |
| 7,172,028 | B2 | | 2/2007 | Barbee et al. | |

OTHER PUBLICATIONS

Porta-Lathe, Inc. brochure, date unknown, 3 pages.
Wachs Subsea—Deepwater Diamond Wire Saw brochure, date unknown, 2 pages.

* cited by examiner

*Primary Examiner* — Thomas Beach
*Assistant Examiner* — Aaron Lembo
(74) *Attorney, Agent, or Firm* — Patterson & Sheridan, L.L.P.

(57) ABSTRACT

Embodiments of the present invention generally relate to a casing tester for plugging and abandoning a wellbore. In one embodiment, a method of testing an annulus defined between a first tubular string and a second tubular string includes engaging a first annular packer with an outer surface of the first tubular string and engaging a second annular packer with an outer surface of the second tubular string. The tubular strings extend into a wellbore. The method further includes injecting a test fluid between the packers until a predetermined pressure is exerted on the annulus.

14 Claims, 8 Drawing Sheets

CASING ANNULUS TESTER FOR DIAGNOSTICS AND TESTING OF A WELLBORE

BACKGROUND OF THE INVENTION

1. Field of the Invention

Embodiments of the present invention generally relate to a casing tester for plugging and abandoning a wellbore.

2. Description of the Related Art

FIG. 1A is a cross section of a prior art sub-sea wellbore 5 drilled and completed with a land-type completion 1. A conductor casing string 10 may be set from above sea-level 15, through the sea 20, and into the sea-floor or mudline 25. The conductor casing 10 provides for mud-returns and allows the wellhead 30 to be located at sea-level 15 rather than on the sea-floor 25.

Once the conductor casing 10 has been set and cemented 35 into the wellbore 5, the wellbore 5 may be drilled to a deeper depth. A second string of casing, known as surface casing 40, may then be run-in and cemented 45 into place. As the wellbore 5 approaches a hydrocarbon-bearing formation 50, i.e., crude oil and/or natural gas, a third string of casing, known as production casing 55, may be run-into the wellbore 5 and cemented 60 into place. Thereafter, the production casing 55 may be perforated 65 to permit the fluid hydrocarbons 70 to flow into the interior of the casing. The hydrocarbons 70 may be transported from the production zone 50 of the wellbore 5 through a production tubing string 75 run into the wellbore 5. An annulus 80 defined between the production casing 55 and the production tubing 75 may be isolated from the producing formation 50 with a packer 85.

Additionally, a stove or drive pipe may be jetted, driven, or drilled in before the conductor casing 10 and/or one or more intermediate casing strings may be run-in and cemented between the surface 40 and production 55 casing strings. The stove or drive pipe may or may not be cemented.

FIG. 1B is a cross section of the completion 1 damaged by a hurricane. Hurricanes in the Gulf of Mexico have recently damaged or destroyed several production platforms (not shown) along with the completions 1. The production platforms and the completions 1 have sunk to the sea-floor 25. Many of the wellbores 5 had been in production for many years, thereby depleting the formations 50 such that the platform operators desire to plug and abandon the wellbores 5. To plug and abandon the wellbores 5, the annulus between the surface 40 and production 75 casing strings must be tested to ensure integrity of the cement 60 so that hydrocarbons do not leak into the sea 20 and/or sensitive non-hydrocarbon formations, such as aquifers.

SUMMARY OF THE INVENTION

Embodiments of the present invention generally relate to a casing tester for plugging and abandoning a wellbore. In one embodiment, a method of testing an annulus defined between a first tubular string and a second tubular string includes engaging a first annular packer with an outer surface of the first tubular string and engaging a second annular packer with an outer surface of the second tubular string. The tubular strings extend into a wellbore. The method further includes injecting a test fluid between the packers until a predetermined pressure is exerted on the annulus.

In another embodiment, a method of plugging a subsea wellbore having a damaged land-type completion includes cutting a horizontal portion of the completion from a vertical portion of the completion. The completion includes a production casing string, a second casing string adjacent the production casing string, and an annulus defined between the casing strings. The method further includes tier-cutting the vertical portion of the completion into a wedding cake configuration and clamping a casing tester on the wedding cake configuration. The casing tester includes: a first annular blowout preventer (BOP), a second annular BOP, an inlet, a valve, and a pressure gage. The method further includes engaging the annular BOPs with respective casing strings, thereby isolating the annulus; injecting a test fluid into the inlet; closing the valve; and monitoring the pressure gage.

In another embodiment, a method of working over, abandoning, or regaining control over a wellbore includes clamping a wellhead on a casing string extending into the wellbore and cemented to the wellbore. The wellhead includes a first annular blowout preventer (BOP), a second annular BOP, and an outlet. The method further includes engaging the first annular BOP with the casing string; running a work string through the second annular BOP into the wellbore; engaging the second annular BOP with the workstring; injecting fluid into the wellbore through the work string; and returning fluid from the wellbore through the outlet.

In another embodiment, a method of working over, abandoning, or regaining control over a wellbore includes clamping a wellhead on a casing string extending into the wellbore and cemented to the wellbore, wherein the wellhead comprises a first annular blowout preventer (BOP), a second annular BOP, and an outlet. The method further includes engaging the first annular BOP with the casing string; engaging the second annular BOP with a tubular string extending into the wellbore; injecting fluid into the wellbore; and returning fluid from the wellbore through the outlet.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
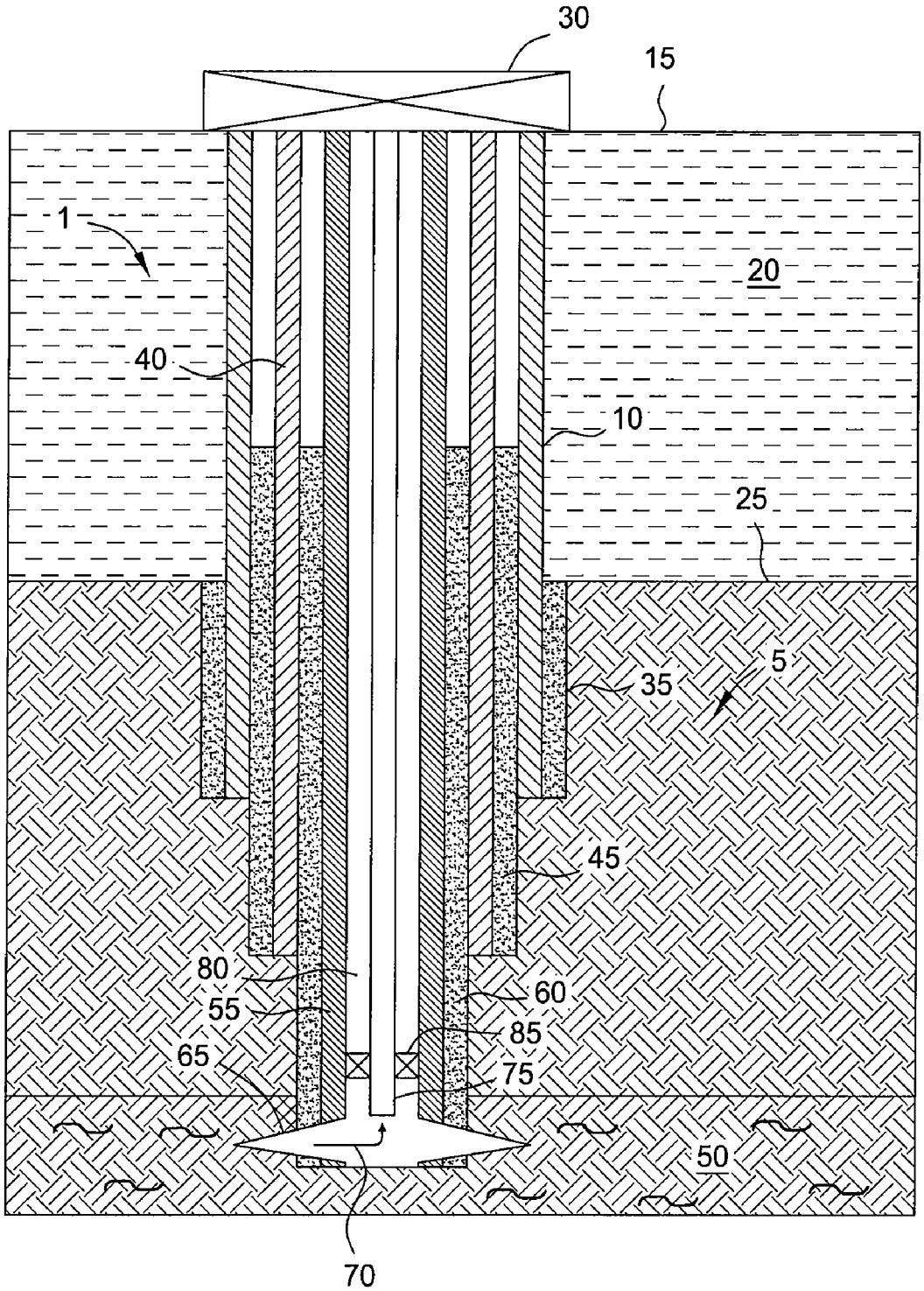
FIG. 1A (PRIOR ART)
FIG. 1A is a cross section of a prior art sub-sea wellbore 5 drilled and completed with a land-type completion.
Figure 1B:
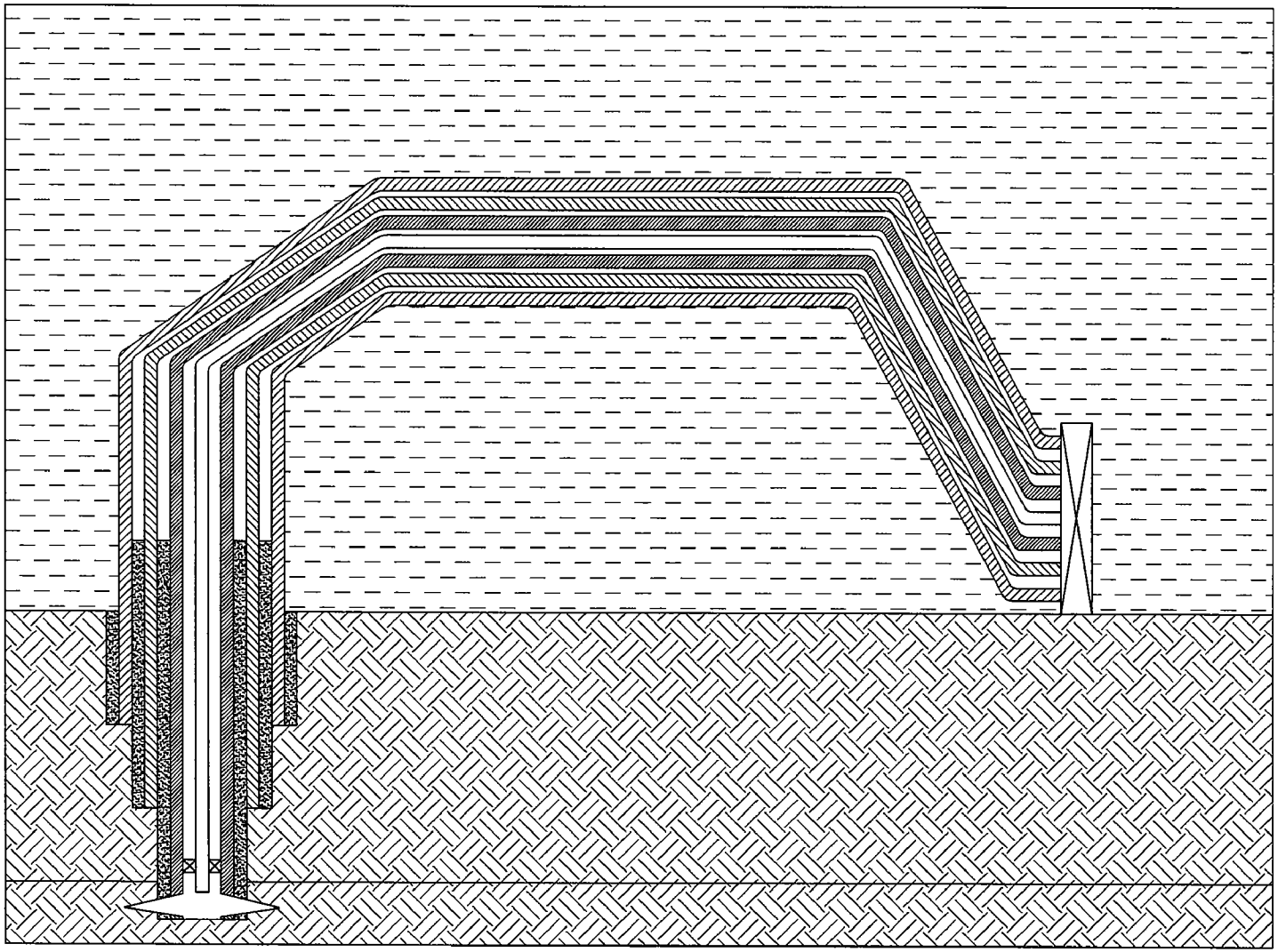
FIG. 1B (PRIOR ART)
FIG. 1B is a cross section of the completion damaged by a hurricane.
Figure 2:
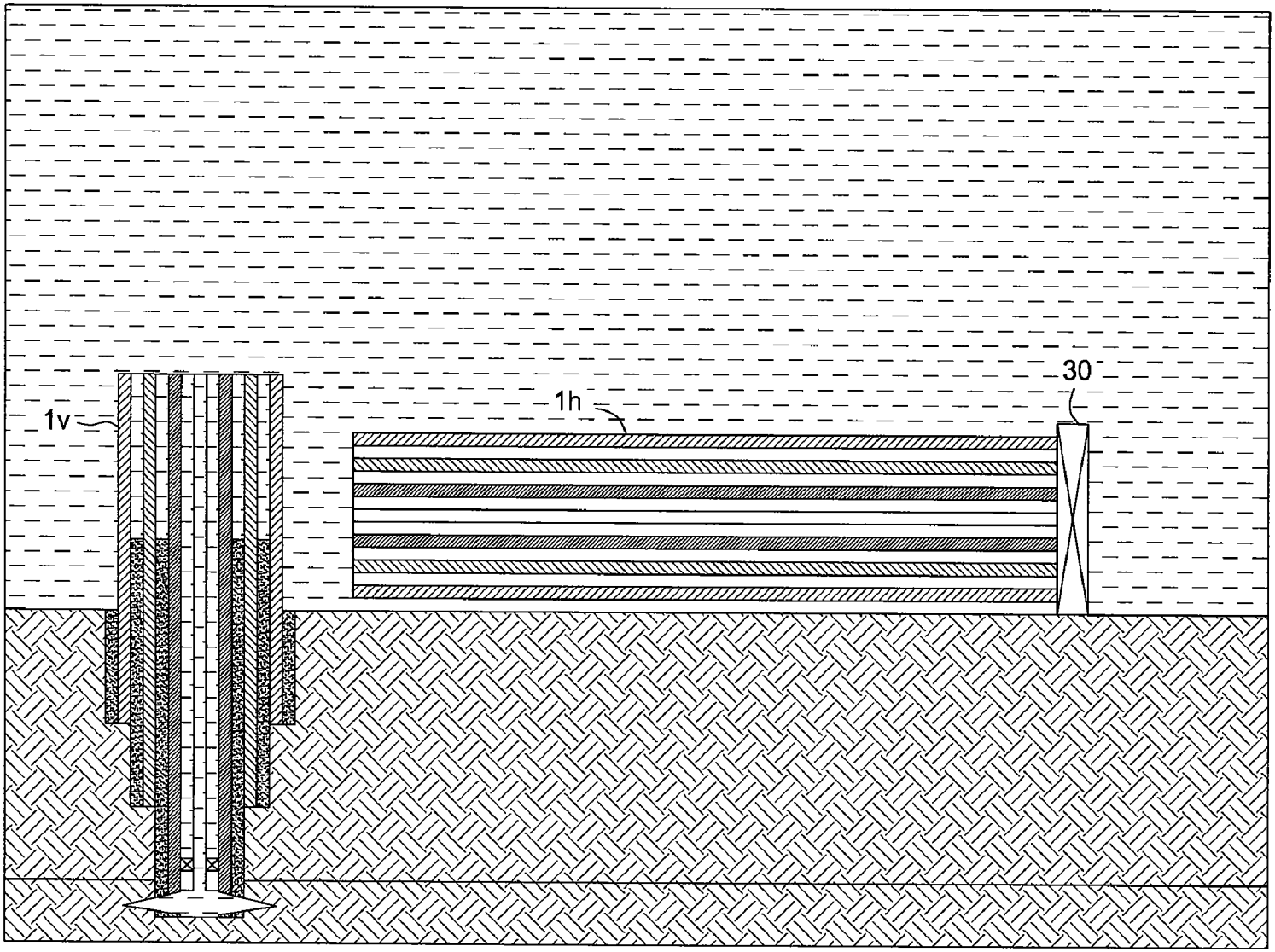
FIG. 2 illustrates a horizontal portion of the completion severed from a vertical portion of the completion, according to one embodiment of the present invention.

FIG. 2 illustrates a horizontal portion 1*h* of the completion 1 severed from a vertical portion 1*v* of the completion, according to one embodiment of the present invention. To begin the plug and abandonment operation (P&A), a diver may be dispatched from a salvage vessel (not shown) to the submerged wellhead 30. Alternatively, a remotely operated vehicle (ROV) (not shown) may be deployed instead of the diver. The diver may operate valves of the wellhead 30 to bleed pressure from the wellbore 5 and to fill the wellbore 5 with seawater to kill the formation 50. To bleed pressure from the wellbore 5, a line may be run to the salvage vessel to remove built-up hydrocarbons from the wellbore 5 so they are not dumped into the sea. Alternatively, a kill fluid, such as heavy mud, may be injected into the wellhead 30 from the salvage vessel to kill the formation if seawater is insufficient to do so. If the damage to the completion 1 has breached the casings 10, 40, 55, and the production tubing 75 and/or the wellhead 30, the wellbore 5 may already be filled with seawater. The diver may then locate and sever the horizontal portion 1*h* of the completion 1 from the vertical portion 1*v* of the completion 1 using a saw (not shown), such as a band saw, reciprocating saw, or a diamond wire saw. The cut may be along the vertical portion 1*v* so that the cut is horizontal. The vertical portion 1*v* may usually be at or near a location where the completion extends from the sea-floor 25 or surface of the earth.

Figure 2A:
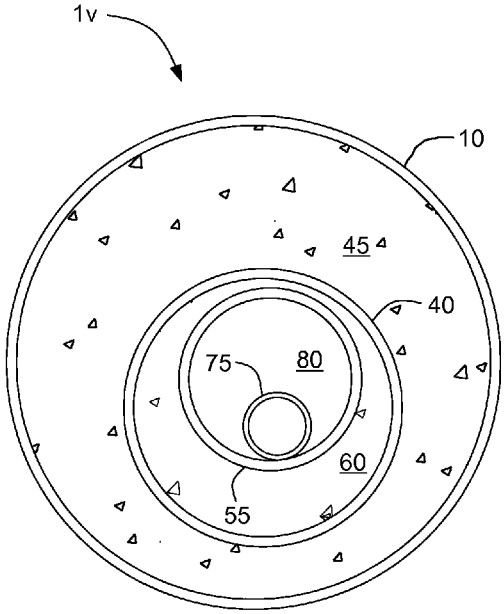
FIG. 2A is plan view of the vertical portion of the completion.
Figure 4B:
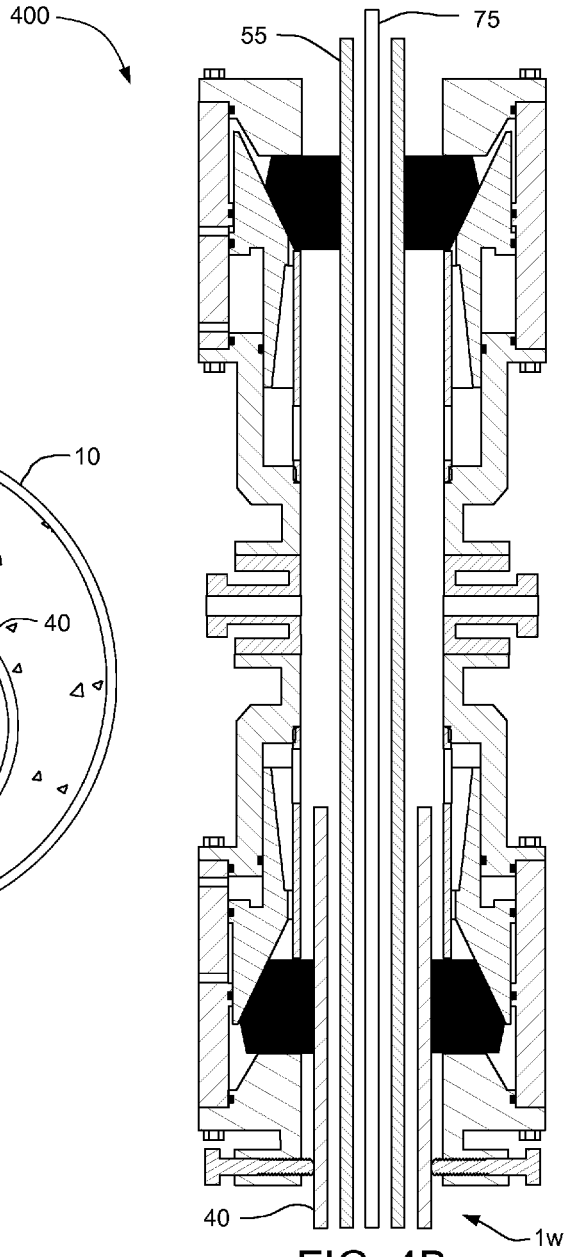
FIG. 4B is a section of the casing test assembly installed on the wedding cake.

FIG. 2A is plan view of the vertical portion 1*v* of the completion 1. Ideally, the casings 10, 40, 60 and the production tubing 75 are concentrically arranged; however, in practice, an eccentric arrangement is far more likely. The eccentric arrangement may vary from wellbore to wellbore and complicates the P&A operation, specifically isolating and testing the annulus between the surface 40 and production 60 casing strings.

Figure 3:
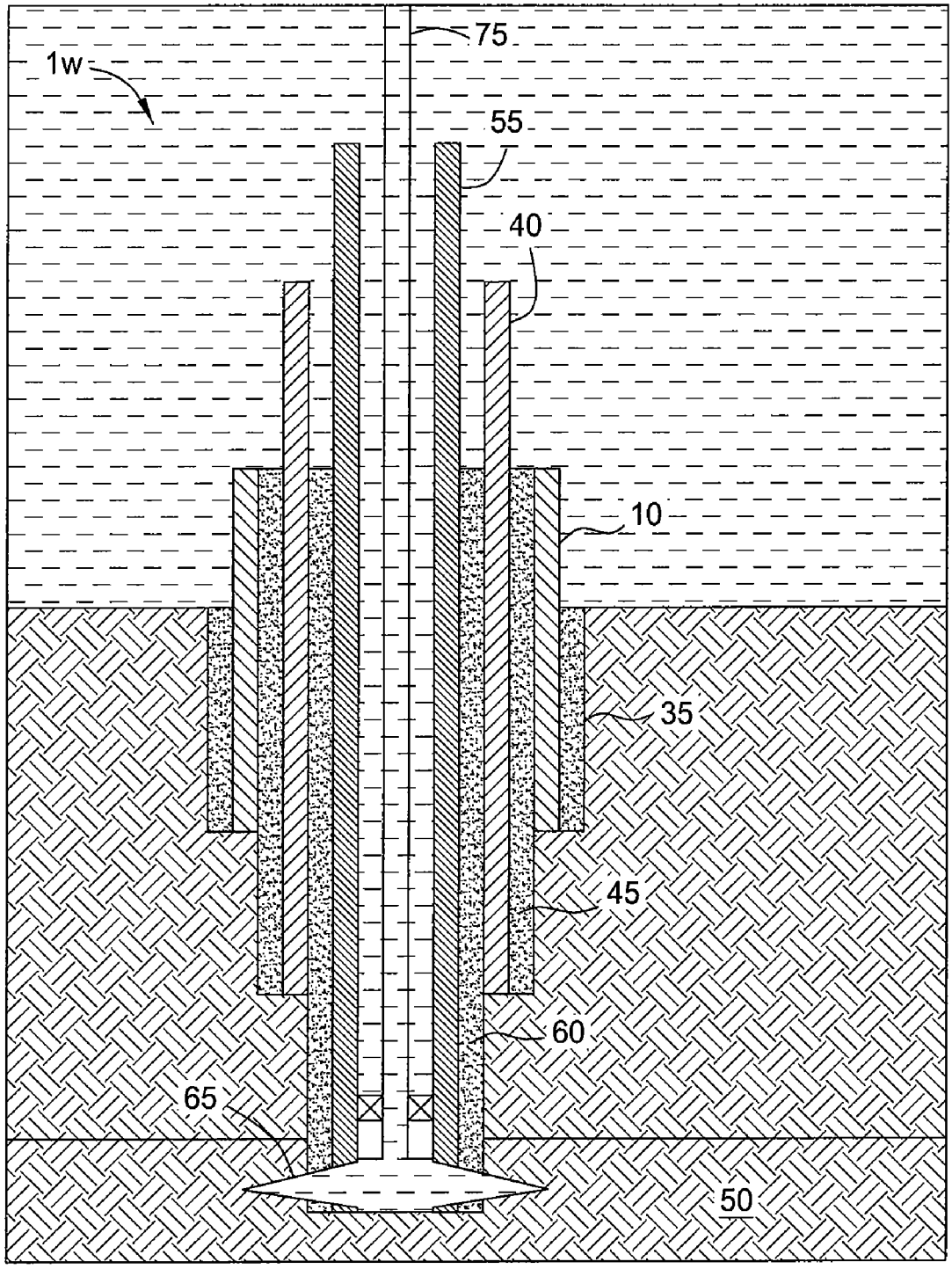
FIG. 3 illustrates the vertical portion of the completion tier-cut into a wedding cake.

FIG. 3 illustrates the vertical portion 1*v* of the completion 1 tier-cut into a wedding cake 1*w* configuration. The cement 45, 60 levels shown are arbitrary as they may vary from wellbore to wellbore. There may or may not be cement 45, 60 between respective casings 10, 40, 55 obstructing the tier-cut operation. The tier-cut operation may proceed as follows. Holes may then be drilled through the conductor 10 and surface 40 casings by the diver. Shackles may then be installed by the diver using the holes to secure the casings 10, 40. Two vertical cuts may be made through the conductor casing 10 by the diver from a top of the vertical portion 1*v* to the top of the conductor casing 10 shown in FIG. 3. The vertical cuts may be spaced at one-hundred eighty degrees.

A hydraulically-powered cutting tool, such as a port-a-lathe, may then be secured to the conductor casing 10 by the diver at or near the top of the vertical portion 1*v*. The diver may operate the port-a-lathe to radially cut through the conductor casing 10. The diver may then re-position the port-a-lathe near the top of the conductor casing shown in FIG. 3. The diver may operate the port-a-lathe to again radially cut through the conductor casing. The diver may then remove the port-a-lathe and the shackles and secure a cable connected to a crane on the salvage vessel to remove the cut portion of the conductor casing 10, thereby exposing the surface casing 40. The operation may then be repeated for the surface casing 40 and the production casing 55. Before the vertical cuts are made, the diver may water blast the cement 45, 60, if necessary. If necessary, the production tubing 75 may simply be cut with a reciprocating saw.

Figure 4:
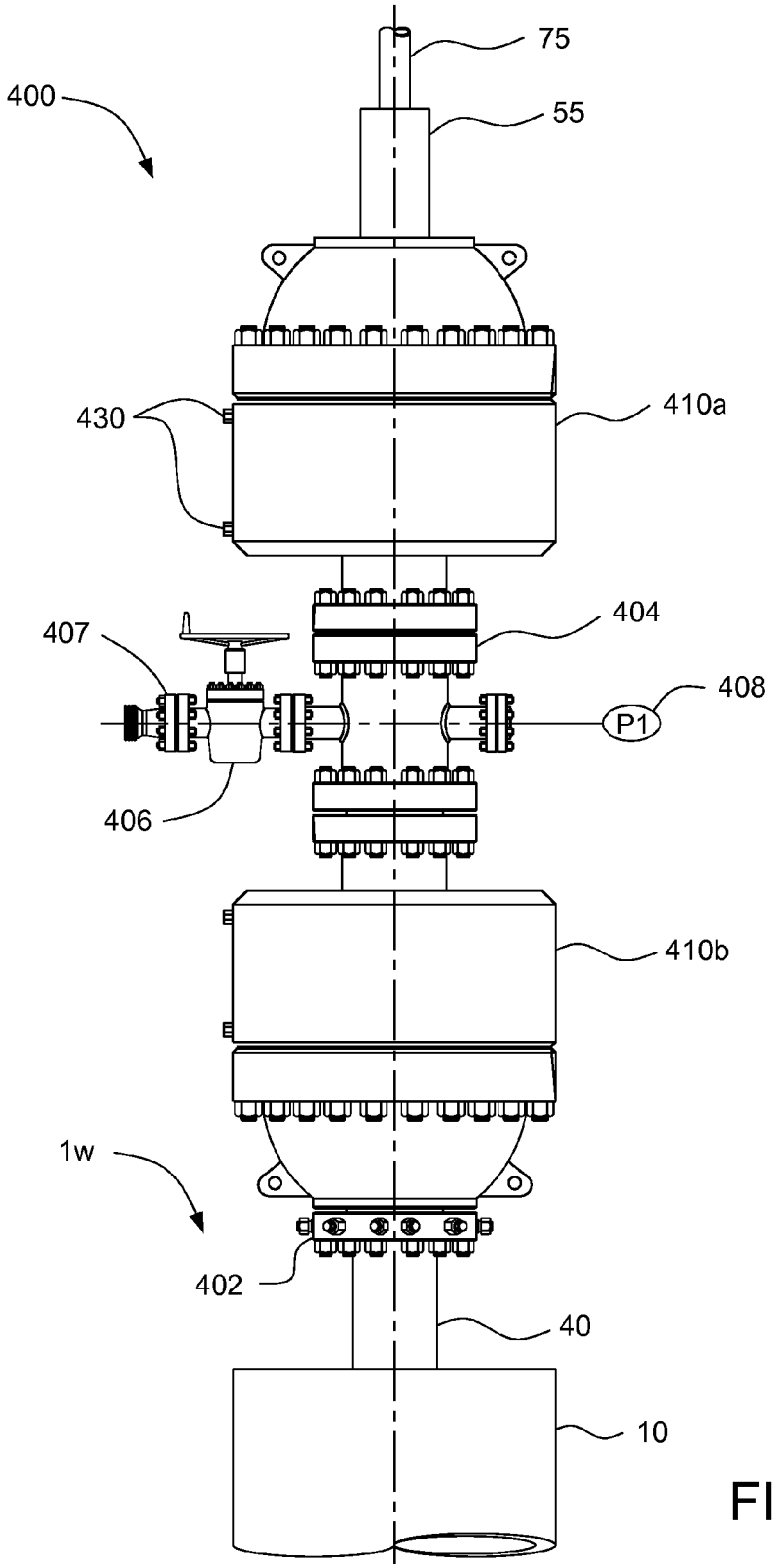
FIG. 4 illustrates a casing test assembly installed on the wedding cake.

FIG. 4 illustrates a casing tester 400 installed on the wedding cake 1*w*. The casing tester 400 may include a clamp, such as retention flange 402, upper 410*a* and lower 410*b* annular blowout preventers (BOPS) (i.e., conical or spherical), a spool 404, a valve 406, such as a manually operated gate valve 406, an inlet 407, and a pressure gage 408. The casing tester 400 may be assembled on the salvage vessel or as the tester is being installed on the wedding cake 1*w*. The casing tester 400 may be longitudinally coupled to the surface casing 40 by the retention flange 402. The retention flange 402 may include a plurality of fasteners, such as retainer screws, that engage an outer surface of the surface casing 40. The retainer flange 402 may be fastened or welded to the lower annular BOP 410*b*. The lower annular BOP 410*b* may be fastened to the spool 404 by a flanged connection. The upper annular BOP 410*a* may be fastened to the spool 404 by a flanged connection. The spool 404 may include one or more branches. The valve 406 may be fastened to a first branch of the spool 404 by a flanged connection. The inlet 407 may be fastened to the valve 406 by a flanged connection. The inlet 407 may include an end for receiving a hydraulic line, such as a hose, from the salvage vessel. The inlet end may be threaded. The pressure gage 408 may be fastened to the second branch by a flanged connection.

Figure 4A:
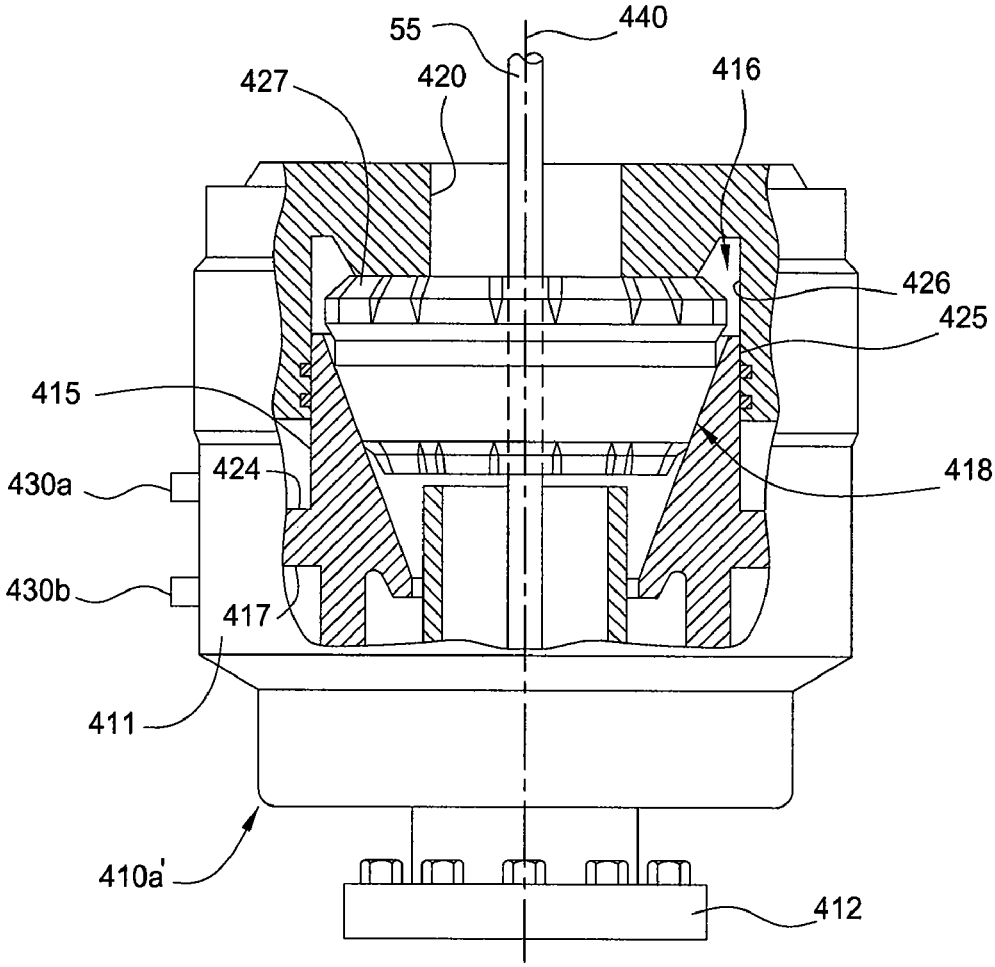
FIG. 4A is a section of an annular BOP.

FIG. 4A is a cross-section of an annular BOP 410*a*' similar to the first annular BOP 410*a* and usable with the casing tester 400. The second annular BOP 410*b* may be modified by inverting one of the BOPs 410*a*, 410*a*' and fastening or welding the retention flange 402 onto the bottom (top before inversion). Alternatively, the retention flange 402 may be fastened or welded to the upper annular BOP 410*a* instead of the lower annular BOP 410*b* so that the casing tester 400 is longitudinally coupled to the production casing 55 instead of the surface casing 40. Alternatively, a two-piece hinged pipe clamp may be used instead of the retention flange 402.

The annular BOP 410*a*' may include a housing 411. The housing 411 may be made from a metal or alloy and include a flange 412 welded thereto. The housing 411 may include upper and lower portions fastened together, such as with a flanged connection or locking segments and a locking ring. A piston 415 may be disposed in the housing 411 and movable upwardly in chamber 416 in response to fluid pressure exertion upwardly against piston face 417 via hydraulic port 430*a*. Movement of the piston 415 may constrict an annular packer 418 via engagement of an inner cam surface 422 of the piston with an outer surface of the packer 418. The engaging piston and packer surfaces may be frusto-conical and flared upwardly. The packer 418, when sufficiently radially inwardly displaced, may sealingly engage an outer surface of a respective one of the casings 40, 55 extending longitudinally through the housing 411. In the absence of any casing disposed through the housing 411, the packer 418 may completely close off the longitudinal passage 420 through the housing 410, when the packer 418 is sufficiently constricted by piston 415. Upon downward movement of the piston 416 in response to fluid pressure exertion against face 424 via hydraulic port 430*b*, the packer 418 may expand radially outwardly to the open position (as shown). An outer surface 425 of the piston 416 may be annular and may move along a corresponding annular inner surface 426 of the housing 416. The packer 418 may be longitudinally confined by an end surface 427 of the housing 411.

The packer 418 may be made from a polymer, such as an elastomer, such as natural or nitrile rubber. Additionally, the packer 418 may include metal or alloy inserts (not shown) generally circularly spaced about the longitudinal axis 440. The inserts may include webs that extend longitudinally through the elastomeric material. The webs may anchor the elastomeric material during inward compressive displacement or constriction of the packer 418.

Returning to FIG. 4, the casing tester 400 may be lowered from the salvage vessel by a crane to the diver. The diver may guide the casing tester 400 onto the wedding cake 1*w* and fasten the retention flange to the surface casing 40. Hydraulic lines may then be connected from the salvage vessel to the hydraulic ports 430 of the annular BOPs 410*a, b*. A testing line may be connected from the salvage vessel to the inlet 407.

The annular BOPs 410*a, b* may then be operated by injection of hydraulic fluid, such as clean oil, from the salvage vessel through respective hydraulic ports 430 until respective packers 418 engage respective casings 40, 55, thereby isolating the annulus between the surface 40 and production 60 casing strings. If there is an intermediate casing string between the surface 40 and production 60 strings, then the tester 400 may be installed on the intermediate and production 60 casings since the annulus adjacent the production casing string is in fluid communication with the formation 50.

Eccentricity of the casings 40, 60, discussed above, does not affect engagement of the pliant packers 418. Testing fluid, such as seawater, may then be injected from the salvage vessel into the inlet 407 until the annulus between the surface 40 and production 55 casing strings is at a predetermined test pressure, such as 500 psi. The valve 406 may be closed by the diver and the diver may monitor the pressure for a predetermined amount of time, such as fifteen minutes, to test the integrity of the cement 60. If the cement 60 is acceptable, the P&A operation may proceed. Alternatively, the valve 406 may be a solenoid valve operable from the salvage vessel and the pressure gage may be a pressure sensor in data communication with the salvage vessel so that the test may be monitored and controlled from the salvage vessel.

If the cement 60 is unacceptable, then remedial action may be taken, such as injecting sealant from the salvage vessel into the annulus via the inlet 407, and then the annulus may be re-tested. The sealant may be cement or a thermoset polymer, such as epoxy or polyurethane.

Alternatively, the casing tester 400 may remain on the wedding cake 1*w* while sealant is injected into the wellbore 5 and up the annulus and then the annulus may be retested. The production tubing 75 may be used to inject the sealant.

Alternatively, the production tubing 75 may be removed and a temporary wellhead installed on the wedding cake 1*w* for injecting the sealant into the wellbore and up the annulus. Fluid from the remedial operation may be returned to the salvage vessel via the inlet 407 (would now be an outlet). A second casing tester may be used as the temporary wellhead for repairing the annulus. The second lower BOP may seal against the production casing 55 while the second upper BOP may be used to seal against a work string run into the wellbore from the salvage vessel, thereby isolating the wellbore. The work string may be may be coiled tubing or drill pipe. The sealant may be injected from the salvage vessel into the wellbore via the workstring.

Alternatively, the casing tester 400 may be adapted to be used on any casing annulus of the completion 1, such as the conductor casing-surface casing annulus. For example, if conductor casing-surface casing annulus is leaking, a larger casing tester may be deployed and installed on the wedding cake 1*w* to inject sealant into the annulus and then test the annulus. Alternatively, the leak could be contained and/or discharged to the salvage vessel via the inlet 407 (would now be an outlet) while the annulus is remedied.

Alternatively, the casing tester 400 may be modified for use on the production casing-production tubing annulus 80. The casing tester 400 may be used to test the packer 85 or may be used as a temporary wellhead for conducting remedial operations using the production tubing 75 if the packer 85 is damaged. The lower BOP 410*b* may seal against the production casing 55 while the upper BOP 410*a* may be used to seal against the production tubing 75, thereby isolating the annulus 80. Using the casing tester 400 to seal the annulus 80 may also be beneficial in an emergency, such as breach of the packer 85. The casing tester 400 may be more quickly installed to contain leakage than a subsea wellhead.

Figure 5:
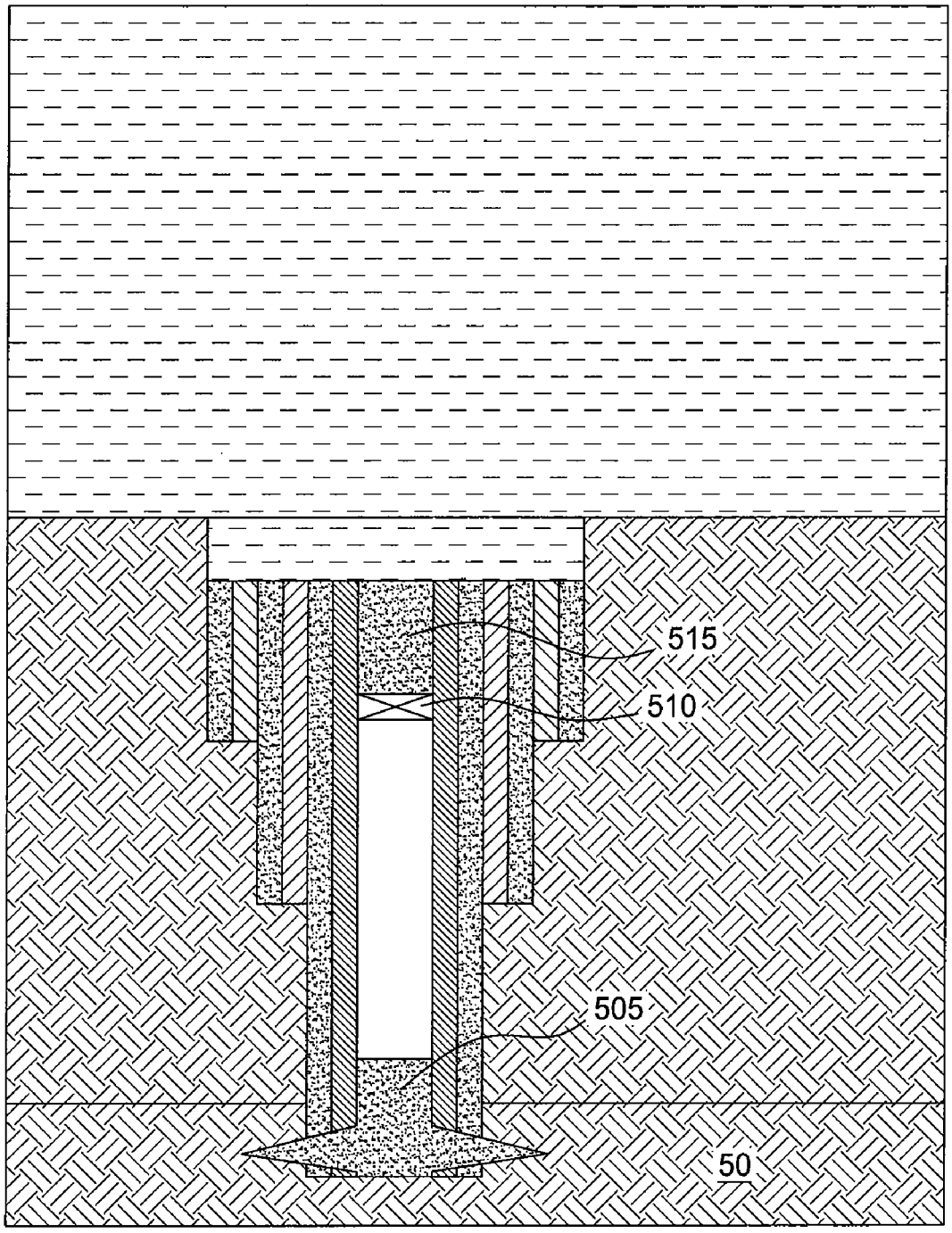
FIG. 5 illustrates the wellbore plugged for abandonment.

FIG. 5 illustrates the wellbore 5 plugged for abandonment. The casing tester 400 may be removed from the wedding cake 1*w* and returned to the salvage vessel. The production tubing 75 may then be removed from the wellbore. A temporary wellhead may be installed on the wedding cake 1*w* for conducting P&A operations in the wellbore 5. As discussed above, the temporary wellhead may be a casing tester 400. Returns from the P&A operation may flow through the inlet 407 (would now be an outlet) to the salvage vessel. A work string, such as coiled tubing, may be run into the wellbore through the wellhead. Sealant may be injected into the wellbore to form a plug 505 and seal the hydrocarbon formation 50. A bridge plug 510 may then be run-in and set. Sealant may be injected above the bridge plug 515 to form a second plug 510 and seal any surface formations. The temporary wellhead may be removed. The casings 10, 40, and 55 may be cut at a predetermined depth below the mudline 25 and the cut portions removed from the wellbore 5.

Alternatively, instead of plugging and abandoning the wellbore 5, a permanent subsea wellhead may be installed on the wedding cake 1*w* and a production line run from the wellhead to a new production platform. The production tubing 75 may be left in the wellbore and engaged by the new wellhead or a new string of production tubing and a new packer 85 installed.

Alternatively, instead of plugging and abandoning the wellbore 5, a temporary wellhead may be installed on the wedding cake 1*w* for working over or re-completing the wellbore 5, such as perforating another hydrocarbon-bearing zone or formation. The casing tester 400 may be used as the temporary wellhead.

Alternatively, the casing tester 400 may be used on land-based wellbores and other types of sub-sea completions, such as subsea-wellhead type completions.

While the foregoing is directed to embodiments of the present invention, other and further embodiments of the invention may be devised without departing from the basic scope thereof, and the scope thereof is determined by the claims that follow.

The invention claimed is:

1. A method of testing an annulus defined between an outer tubular string and an inner tubular string, comprising:

severing an upper portion of the strings from a lower portion of the strings, wherein the strings are severed above a wellbore;

cutting and removing a portion of the lower outer string portion to expose a corresponding portion of the inner string lower portion, thereby forming a wedding cake configuration;

installing a tester onto the wedding cake configuration, the tester comprising: a first annular packer, a second annular packer, and an inlet;

engaging the first annular packer with an outer surface of the outer tubular string, wherein the outer tubular string extends into the wellbore;

engaging the second annular packer with an outer surface of the inner tubular string, wherein the inner tubular string extends into the wellbore, wherein the packers are engaged with the tubulars above the wellbore; and injecting a test fluid into the inlet until a predetermined pressure is exerted on the annulus.

2. The method of claim 1, wherein the wellbore is a subsea wellbore.

3. The method of claim 2, wherein the strings are part of a land-type completion.

4. The method of claim 3, wherein the tubular strings are casing strings cemented to the wellbore.

5. The method of claim 4, wherein the casing strings are severed adjacent to a sea-floor.

6. The method of claim 4, wherein the inner casing string is a production casing string extending to a hydrocarbon-bearing formation.

7. The method of claim 1, wherein the tester further comprises a valve and a pressure gage.

8. The method of claim 7, further comprising closing the valve and monitoring the pressure gage.

9. The method of claim 1, wherein the tubular strings are casing strings cemented to the wellbore.

10. The method of claim 9, wherein the second casing string is a production casing string extending to a hydrocarbon bearing formation.

11. The method of claim 9, further comprising injecting sealant into the inlet and into the annulus if the annulus does not maintain the predetermined pressure.

12. The method of claim 1, wherein the wellbore extends into a hydrocarbon bearing formation and the method further comprises injecting sealant into the wellbore, thereby sealing the formation.

13. The method of claim 12, further comprising cutting the tubulars in the wellbore; and removing the cut portions of the tubulars from the wellbore.

14. The method of claim 1, wherein the packers are engaged with the tubulars adjacent to a sea-floor or surface of the earth.

* * * * *